US010307818B1

(12) United States Patent
Vohl et al.

(10) Patent No.: US 10,307,818 B1
(45) Date of Patent: Jun. 4, 2019

(54) AIR SET SAND MOLDING APPARATUS

(71) Applicant: Wisconsin Aluminum Foundry Company, Manitowoc, WI (US)

(72) Inventors: Mark Vohl, Manitowoc, WI (US); Steve Van Ess, Manitowoc, WI (US)

(73) Assignee: Wisconsin Aluminum Foundry Company, Manitowoc, WI (US)

( * ) Notice: Subject to any disclaimer, the term of this patent is extended or adjusted under 35 U.S.C. 154(b) by 0 days.

(21) Appl. No.: 15/853,335

(22) Filed: Dec. 22, 2017

(51) Int. Cl.
*B22C 17/02* (2006.01)
*B22C 13/02* (2006.01)

(52) U.S. Cl.
CPC ..... *B22C 17/02* (2013.01); *B22C 13/02* (2013.01)

(58) Field of Classification Search
CPC ..... B22C 17/00; B22C 17/02
USPC ..... 164/37, 169, 180, 187, 191, 213, 237, 164/238, 241
See application file for complete search history.

(56) References Cited

U.S. PATENT DOCUMENTS 1,772,463 A * 8/1930 Loudenslager et al. ..... B22C 11/00 164/238
2,822,590 A * 2/1958 Hines ..... B22C 9/20 164/137
3,089,207 A 5/1963 Miller
4,210,194 A * 7/1980 Cina et al. ..... B22C 9/123 164/16
4,553,581 A * 11/1985 Uppgren et al. ..... B22C 15/24 164/16
5,101,881 A * 4/1992 Hunter ..... B22C 7/04 164/239
2006/0108087 A1* 5/2006 Kaneto et al. ..... B22C 15/08 164/37

FOREIGN PATENT DOCUMENTS

KR 20020077266 A 10/2002
KR 20020082707 A 10/2002
KR 20130087138 A 8/2013
WO 2011115348 A1 9/2011

OTHER PUBLICATIONS

International Search Report with Written Opinion for related Application No. PCT/US2018/059730 dated Feb. 22, 2019 (12 pages).

* cited by examiner

*Primary Examiner* — Kevin P Kerns
(74) *Attorney, Agent, or Firm* — Michael Best & Friedrich LLP

(57) ABSTRACT

An air set molding apparatus configured to form a sand mold, the apparatus includes a pattern mounting plate including an ejection pin aperture, a molding flask on the pattern mounting plate, the molding flask having a closed lower end and an open upper end. The molding flask including an ejection pin aperture in the closed lower end, an ejection pin movable relative to the pattern mounting plate and the molding flask, the ejection pin movable through the ejection pin aperture of the pattern mounting plate and the ejection pin aperture of the molding flask between a lowered position and a raised position. As the ejection pin moves from the lowered position to the raised position, the ejection pin lifts the sand mold through the open upper end of the molding flask.

16 Claims, 6 Drawing Sheets

AIR SET SAND MOLDING APPARATUS

BACKGROUND

The present invention relates to an air set sand molding apparatus.

Mold patterns are used to for making sand molds, which include sand mold patterns, sand mold parts, and sand mold cores used in the metal casting process. A pattern is formed in the sand mold and casting fluid is poured into the sand mold. The sand mold can be formed using a method referred to as air set molding. In air set molding, a mixture of sand, a resin, and a catalyst is poured into a molding flask that includes a pattern. The pattern is at least a portion of the cast tooling or part. The mixture cures in the molding flask to create the sand mold. The cured sand mold must be removed from the molding flask, which presents many challenges. To remove the sand mold, the molding flask is turned over or upside down so that the sand mold drops out of the molding flask by gravity. However, this often times damages the sand mold or the sand mold does not fall out of the molding flask by gravity. If the sand mold does not fall out of the molding flask, the user often times hits the molding flask to urge the sand mold out of the molding flask. Hitting the molding flask (e.g., with a hammer) can damage the molding flask and/or the sand mold. The molding flask is intended to be used multiple times. Dropping the sand mold by gravity can damage the sand mold.

SUMMARY

In one embodiment, the invention provides an air set molding apparatus configured to form a sand mold, the apparatus includes a pattern mounting plate including an ejection pin aperture, a molding flask on the pattern mounting plate, the molding flask having a closed lower end and an open upper end. The molding flask including an ejection pin aperture in the closed lower end, an ejection pin movable relative to the pattern mounting plate and the molding flask, the ejection pin movable through the ejection pin aperture of the pattern mounting plate and the ejection pin aperture of the molding flask between a lowered position and a raised position. As the ejection pin moves from the lowered position to the raised position, the ejection pin lifts the sand mold through the open upper end of the molding flask.

In another embodiment the invention provides an air set molding apparatus configured to form a sand mold, the apparatus includes a pattern mounting plate including an ejection pin aperture, an ejection plate movable relative to the pattern mounting plate between a lowered position and a raised position, and an ejection pin coupled to the ejection plate for movement with the ejection plate between the lowered position and the raised position. The ejection pin is movable through the ejection pin aperture of the pattern mounting plate as the ejection plate moves from the lowered position to the raised position to lift the sand mold away from the pattern mounting plate.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
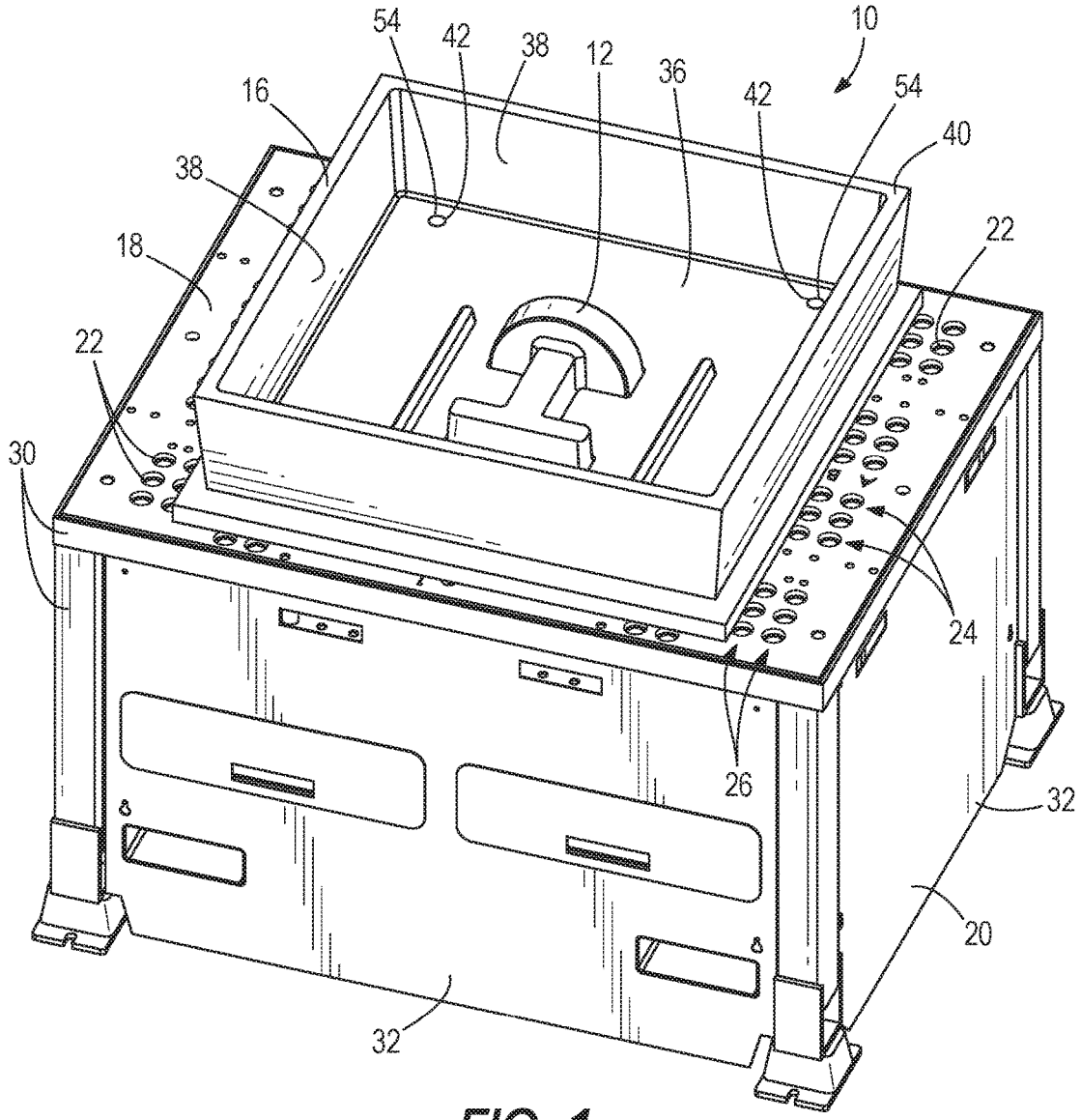
FIG. 1 is a perspective view of an air set molding apparatus according to one embodiment of the invention.

FIG. 1 illustrates an air set sand molding apparatus 10 that is used to create or form a sand mold 14 (FIG. 6) of a pattern 12. Air set sand molding is also referred to as and includes pepset sand molding, all-core sand molding, dry sand molding, no-bake sand molding, chemically bonded sand molding, and the like.

As will be discussed below, the air set molding apparatus 10 automatically and easily removes a cured sand mold 14 (FIG. 6) from a molding flask 16 with very low risk of damage to the mold 14 and the molding flask 16. The sand mold 14 can include sand mold pattern, sand mold part, sand mold core, and the like.

Figure 3:
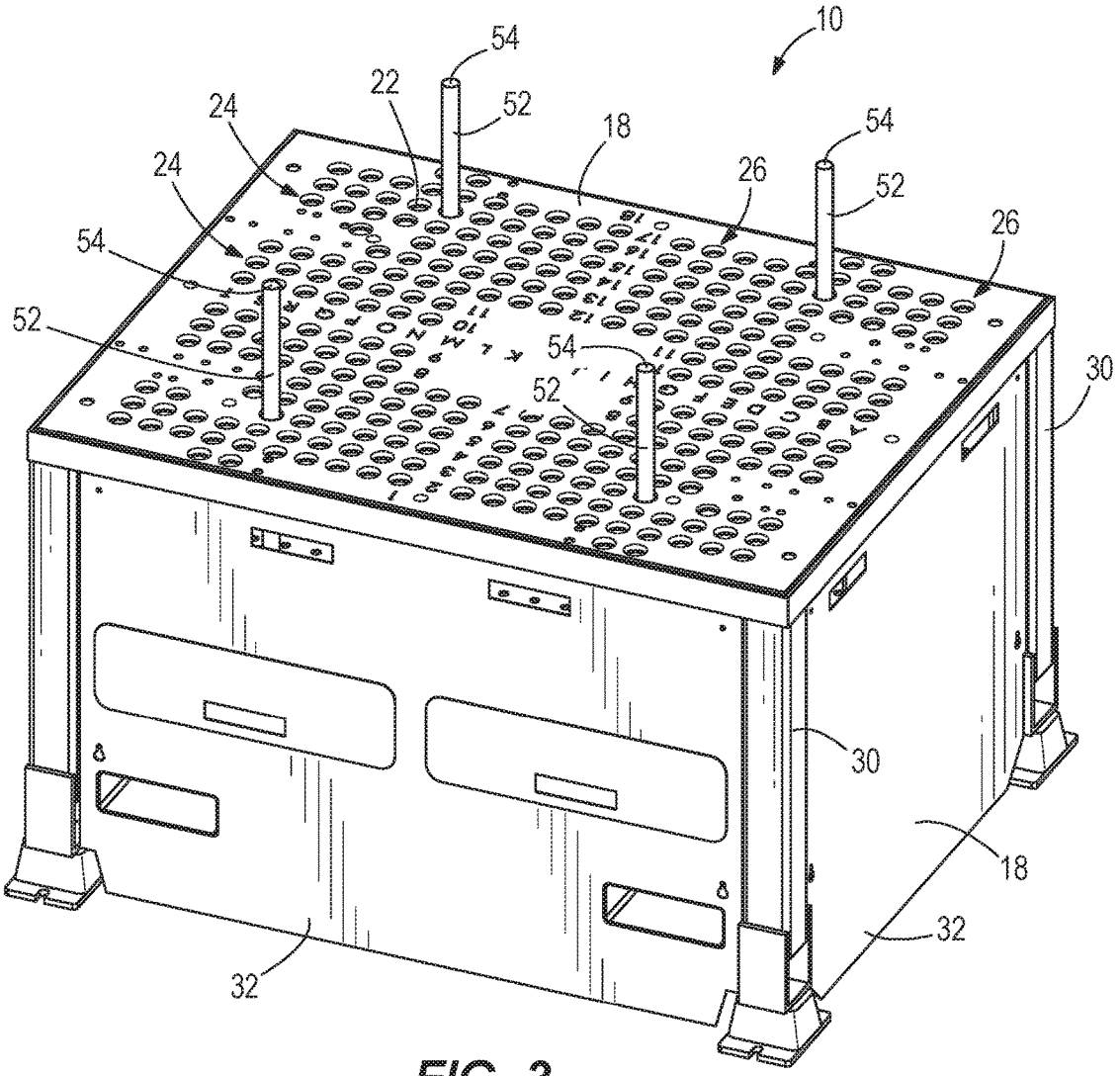
FIG. 3 is a perspective view of the air set molding apparatus of FIG. 1 with a molding flask removed and ejection pins in a raised position.

Referring to FIG. 1, the air set sand molding apparatus 10 includes a pattern mounting plate 18, a frame 20, and the molding flask 16. The pattern mounting plate 18 has a top side and a bottom side. The molding flask 16 is supported on the top side of the plate 18. As best seen in FIG. 3, the pattern mounting plate 18 includes several ejection pin apertures 22. The ejection pin apertures 22 extend all the way through the plate 18, that is through the top and bottom sides of the plate 18. The apertures 22 are arranged in rows 24 and columns 26 to form a grid like pattern on the plate 18.

The frame 20 supports the pattern mounting plate 18 above the floor at a convenient working height for the user. For example, in some embodiments, the frame 20 holds the plate 18 about 30 to 40 inches above the floor. The frame 20 includes supports 30 and panels 32. The panels 32 are removably coupled to the supports 30 to that the user can access components within the frame 20 and hidden by the panels 32.

Figure 2:
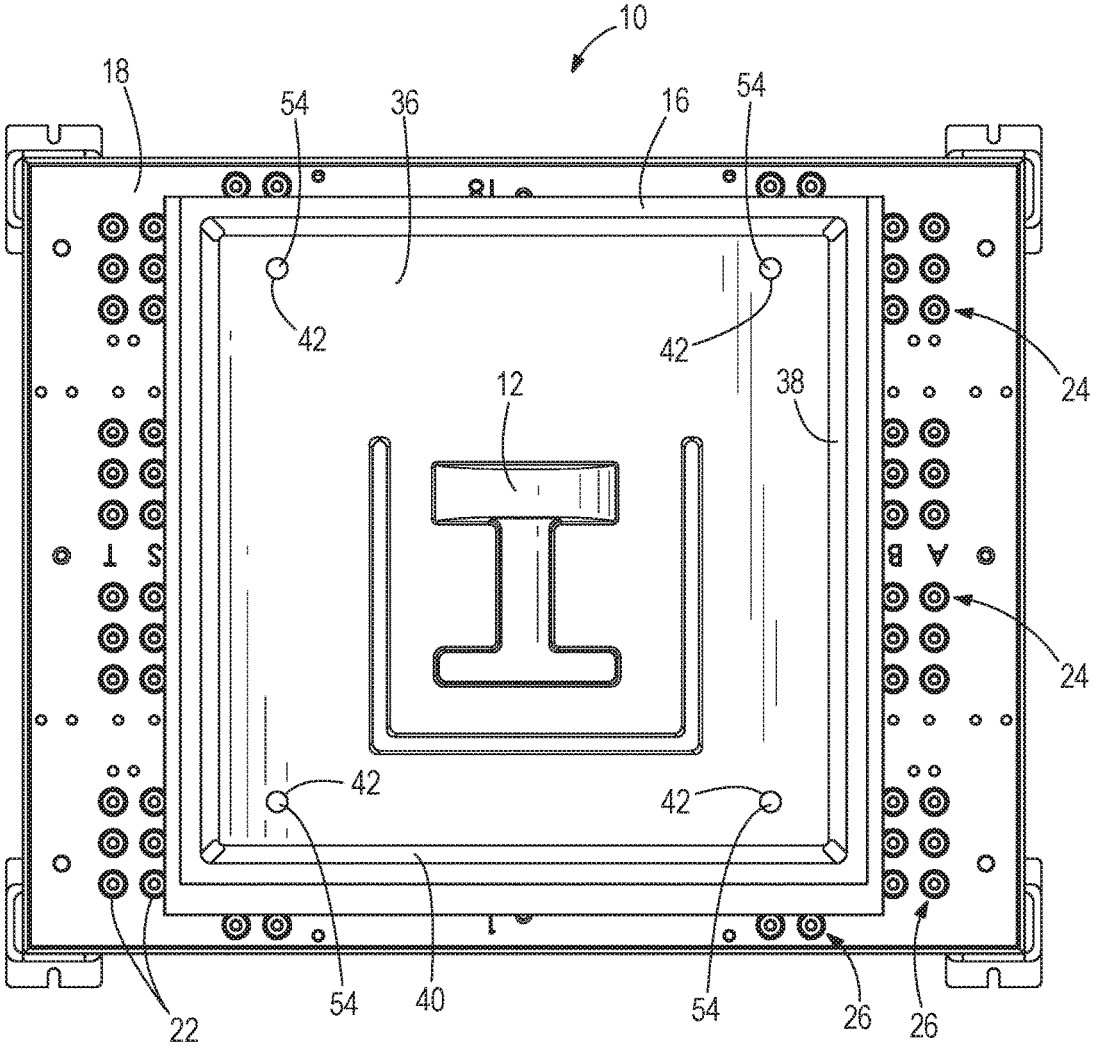
FIG. 2 is a top view of the air set molding apparatus of FIG. 1.

Referring to FIGS. 1 and 2, the molding flask 16 includes a lower end or bottom wall 36 and sidewalls 38 that extend up from the lower end 36. Upper ends of the sidewalls 38 define and open upper end 40 of the molding flask 16. Molding flask ejection pin apertures 42 extend through the bottom wall or lower end 36 of the molding flask 16. In the illustrated embodiment, four apertures 42 extend through the bottom wall 36 of the molding flask 16. In other embodiments, fewer or more than four apertures 42 extend through the wall 36. The apertures 42 of the molding flask each align with one of the ejection pin apertures 22 of the plate 18 to form a generally continuous through hole or through aperture.

The pattern 12 is located inside the molding flask 16 below the open upper end 40 of the molding flask 16. In the illustrated embodiment, the pattern 12 is formed in the bottom wall 36 of the flask 16 and then the sidewalls 38 are attached to the bottom wall 36. In other embodiments, the sidewalls 38 can be already or permanently attached to the bottom wall 36. In other embodiments, the pattern 12 can be separate component that is set on the bottom wall 36 rather than being integrally formed in the bottom wall 36. The ejection pin apertures 42 of the molding flask 16 are located outside the part pattern 12. That is, the apertures 42 form no part of the part pattern 12 and do not interfere with the part pattern 12. Rather, the apertures 42 are located through the flat area of the bottom wall 36.

Figure 4:
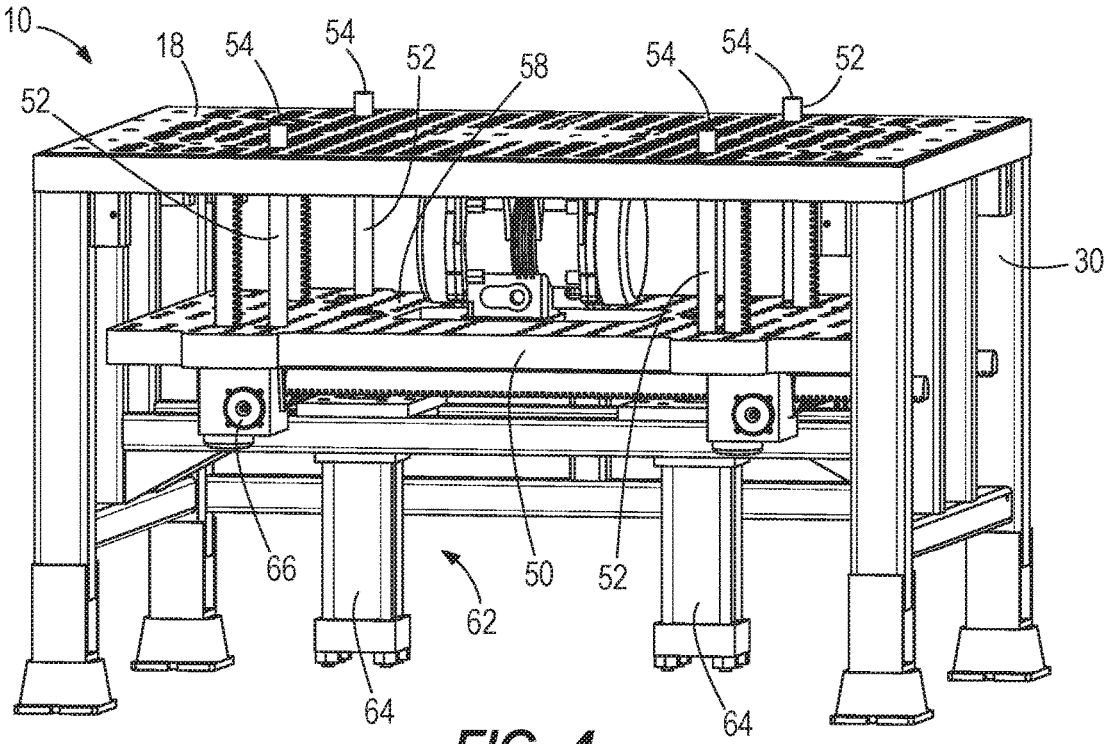
FIG. 4 is a perspective view of the air set molding apparatus with side panels removed and the ejection pins in a lowered position.
Figure 5:
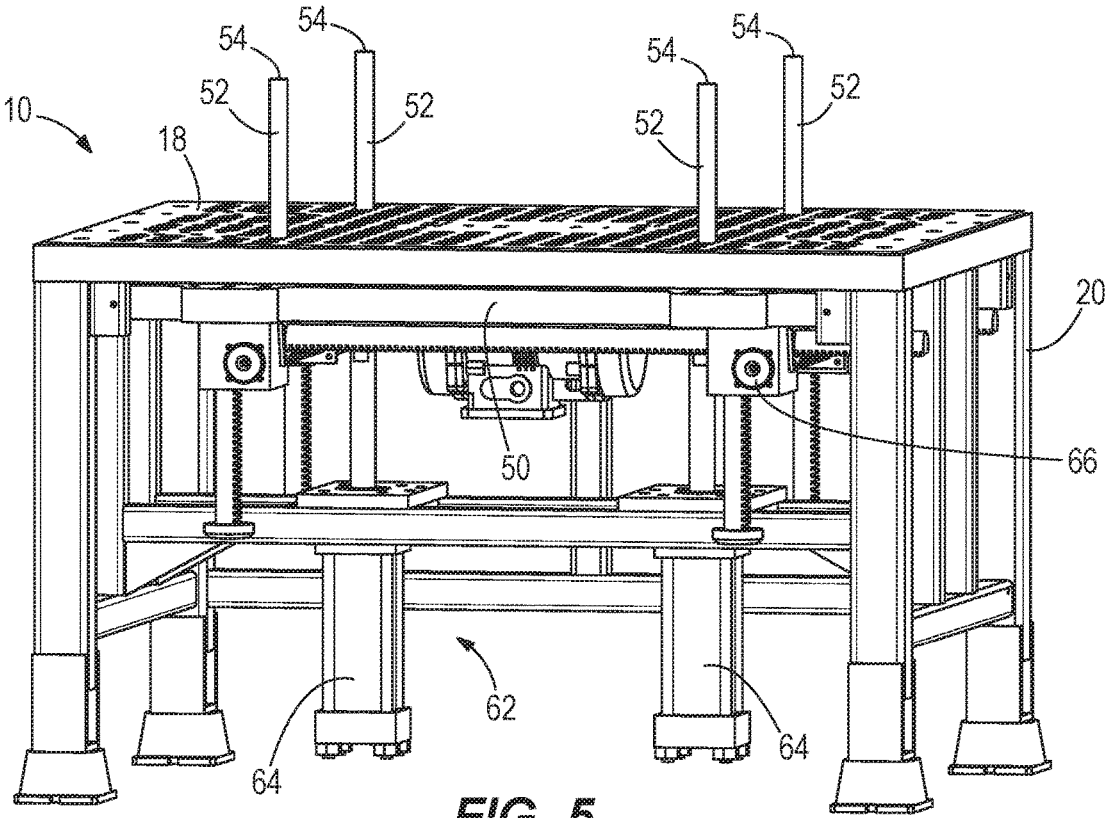
FIG. 5 is a perspective view of the air set molding machine of FIG. 4 but with the ejection pins in the raised position.
Figure 7:
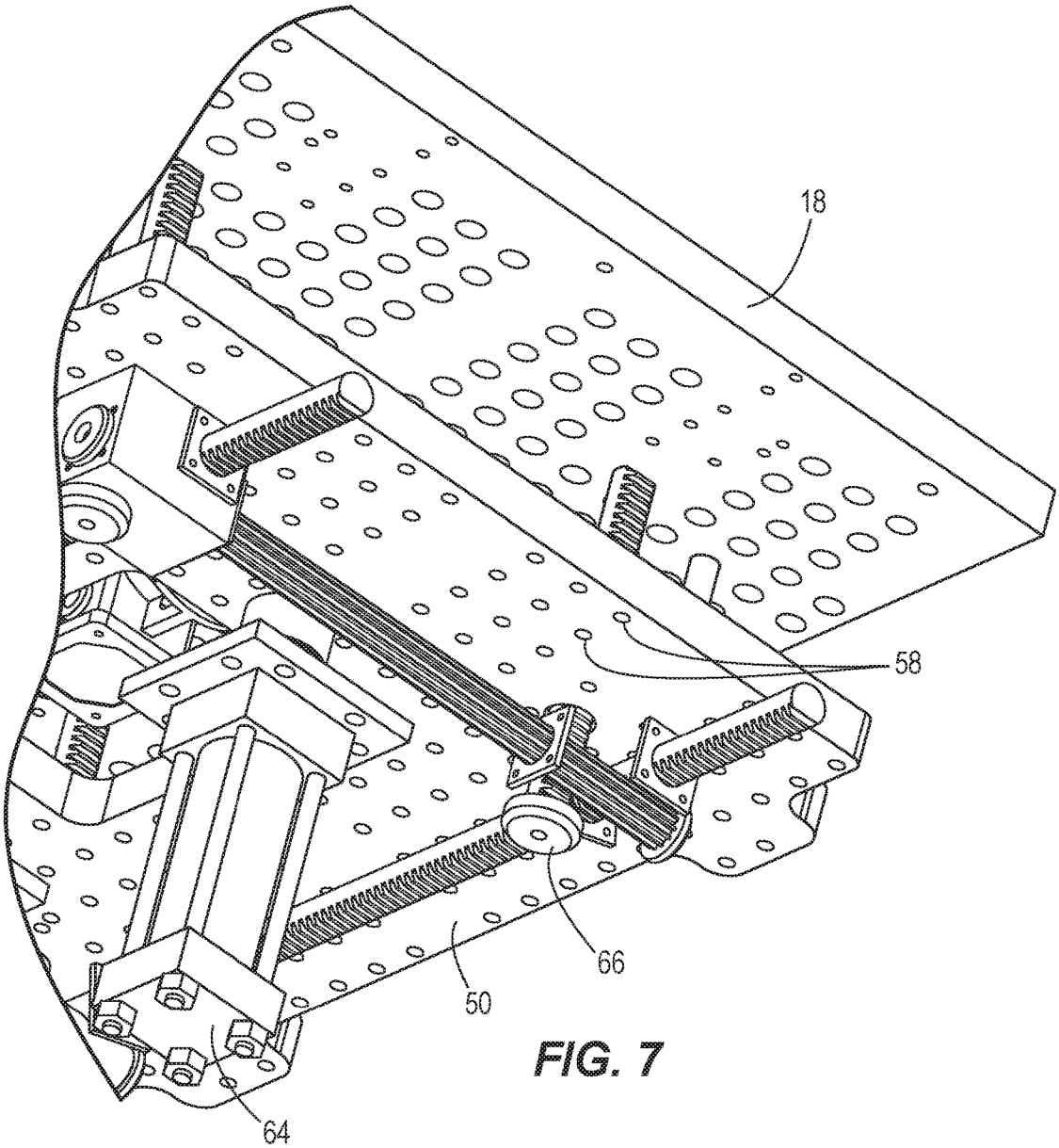
FIG. 7 is a perspective view of a portion of the air set molding machine of FIG. 1.

Referring to FIGS. 4, 5, and 7, the air set sand molding apparatus 10 further includes an ejection plate 50 and ejection pins 52 that are raised and lowered by the ejection plate 50. The ejection plate 50 is underneath or adjacent the bottom side of the pattern mounting plate 18. The ejection plate 50 is located inside the frame 20 and panels 32 (FIG. 1). The ejection plate 50 is movable up and down relative to the plate 18 and frame 20 between a lowered position (FIG. 4) and a raised position (FIG. 5). It should be understood that the lowered position illustrated in FIG. 4 is just one possible lowered position of the ejection plate 50. The ejection plate 50 may be further lowered so that the ejection pins 52 do not extend at all beyond the top of the mounting plate 18. However, in one embodiment, the lowered position is set so that upper ends 54 of pins 52 are flush with the top of the bottom wall 36 of the molding flask 16. Therefore, the upper ends 54 of the pins 52 extend slightly beyond the top of the mounting plate 18 (e.g., the thickness of bottom wall 36).

The ejection plate 50 includes several ejection pin apertures 58. The ejection pin apertures 58 are arranged in columns and rows similar to the pattern mounting plate 18. The location of the apertures 58 of the ejection plate 50 relate or match up with the location of the apertures 22 of the mounting plate 18. That is, each of the apertures 58 of the ejection plate 50 lines up with one of the apertures 22 of the mounting plate 18. The pin apertures 58 of the ejection plate 50 are sized to receive an ejection pin 52 to couple the ejection pin 52 for movement up and down with the ejection plate 50 related to the pattern mounting plate 18. For example, in one embodiment, the pin apertures 58 are blind bores, not through bores, in the plate 50 to support the pins 52 for movement with the plate 50. In other embodiments, the pins 52 have an interference fit with the apertures 58.

The air set sand molding apparatus 10 further includes a drive 62 that moves the ejection plate 50 between the raised and lowered position. The illustrated drive 62 includes hydraulic cylinders 64 that raise the plate 50 and allow the plate 50 to be lowered when desired. A double rack and pinion system 66 is utilized to ensure that plate 50 is raised and lowered in a level and even manner and so that one part of the plate 50 does not raise or lower at a different rate. It should be understood that the drive 62 is just one of many possible drive devices that could be used to raise and lower the ejection plate 50. In other embodiments, other suitable drives can be used, such as electric motors, pneumatic or pressurized air, etc.

Figure 6:
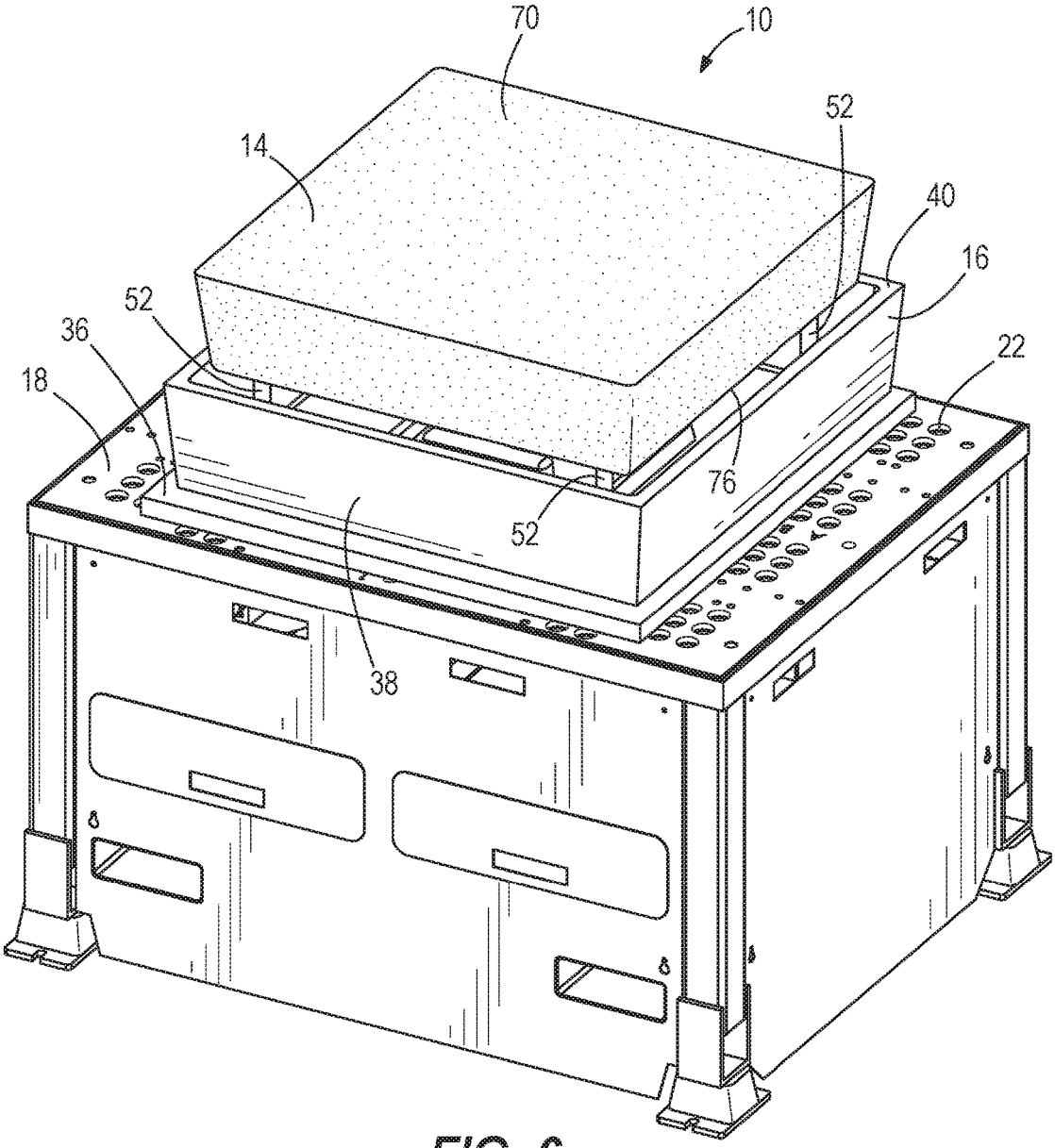
FIG. 6 is a perspective view of the air set molding machine of FIG. 1 with a sand mold in a raised position.

In operation, the ejection plate 50 starts in the lowered position so that the upper ends 54 of the ejection pins 52 are about flush with the bottom wall 36 of the molding flask 16. The user fills the molding flask 16 with a mixture of sand, catalyst, resin, and an activator. The mixture fills in around the part pattern 12 while the user typically strikes the mixture off using the sidewalls 38 of the flask 16 as a guide to create a level surface 70 (see FIG. 6) on top of the mold. The mixture is given time to cure and harden. Then, the user moves the ejection plate 50 toward the raised position (see FIGS. 3 and 6) using the drive 62 and associate control system. As the ejection plate 50 moves to the raised position, the ejection pins 50 pass through the apertures 22 of the plate 18 and the apertures 42 of the flask 16 and move to a raised position. The pins 50 raise or lift the sand mold 14 out of the flask 16 as shown in FIG. 6. That is, the sand mold 14 is raised above the open upper end 40 of the molding flask 16. As discussed above, the ejection pins 52 that lift the sand mold 14 are outside the perimeter of the pattern 12. Therefore, the pins 52 lift and press against a flat part 76 of the sand mold 14, which is a waste portion, and the pins 52 do not press against the cavity created by the pattern 12 in the mold pattern 14. The pins 52 pressing against the cavity created by the pattern 12 may damage the sand mold 14 or otherwise create undesirable surface features on the final product created by the mold. The user can then easily lift or otherwise move the sand mold 14 to another location because the mold has be lifted out of the flask 16.

The air set sand molding apparatus 10 and ejection system can easily be reconfigured for use with a different molding flasks and patterns simply by moving the location of the ejection pins 52 on the ejection plate 50. The pins 52 are uncoupled or removed from the ejection plate pin apertures 58 and repositioned into different apertures 58 depending on the shape and size of the new pattern and molding flask. The pattern mounting plate 18 also has several pin apertures 22, as discussed above, so that the pins 52 can pass through the plate 18 to lift the sand mold as discussed above.

Thus, the invention provides, among other things, an air set molding apparatus that automatically and easily removes the sand mold from the molding flask with very low risk of damage to the sand mold and the molding flask. Various features and advantages of the invention are set forth in the following claims.

What is claimed is:

1. An air set molding apparatus configured to form a sand mold, the apparatus comprising:

a pattern mounting plate including an ejection pin aperture;

a molding flask on the pattern mounting plate, the molding flask having a closed lower end and an open upper end, the molding flask including an ejection pin aperture in the closed lower end;

an ejection pin movable relative to the pattern mounting plate and the molding flask, the ejection pin movable through the ejection pin aperture of the pattern mounting plate and the ejection pin aperture of the molding flask between a lowered position and a raised position, wherein as the ejection pin moves from the lowered position to the raised position, the ejection pin lifts the sand mold through the open upper end of the molding flask, further comprising an ejection plate, the ejection plate movable relative to the pattern mounting plate between a lowered position and a raised position, wherein the ejection pin is coupled to the ejection plate for movement with the ejection plate relative to the pattern mounting plate, and wherein movement of the ejection plate from the lowered position to the raised position moves the ejection pin from the lowered position to the raised position through the ejection pin apertures of the molding flask and the pattern mounting plate.

2. The air set molding apparatus of claim 1, wherein the pattern mounting plate includes a plurality of ejection pin apertures.

3. The air set molding apparatus of claim 2, wherein the pattern mounting plate includes at least ten ejection pin apertures.

4. The air set molding apparatus of claim 3, wherein the at least ten ejection pin apertures are arranged in rows and columns.

5. The air set molding apparatus of claim 2, further comprising at least four ejection pins movable between lowered and raised positions, wherein the pattern mounting plate includes more ejection pin apertures than the apparatus has ejection pins.

6. The air set molding apparatus of claim 1, where the pattern mounting plate includes a top side and bottom side and the ejection pin aperture of the pattern mounting plate extends through the top and bottom sides, wherein the molding flask is set on the top side of the pattern mounting plate and the ejection plate is adjacent the bottom side of the pattern mounting plate.

7. The air set molding apparatus of claim 6, wherein the ejection plate includes an ejection pin aperture that receives the ejection pin to couple the ejection pin to the ejection plate for movement relative to the pattern mounting plate.

8. The air set molding apparatus of claim 7, wherein the ejection plate includes at least ten ejection pin apertures arranged in rows and columns, wherein the pattern mounting plate includes at least ten ejection apertures arranged in rows and columns that relate to the rows and columns of the ejection pin apertures of the ejection plate.

9. An air set molding apparatus configured to form a sand mold, the apparatus comprising:

a pattern mounting plate including an ejection pin aperture;

an ejection plate movable relative to the pattern mounting plate between a lowered position and a raised position; and an ejection pin coupled to the ejection plate for movement with the ejection plate between the lowered position and the raised position, the ejection pin movable through the ejection pin aperture of the pattern mounting plate as the ejection plate moves from the lowered position to the raised position to lift the sand mold away from the pattern mounting plate.

10. The air set molding apparatus of claim 9, wherein the pattern mounting plate includes a plurality of ejection pin apertures.

11. The air set molding apparatus of claim 9, wherein the pattern mounting plate includes at least ten ejection pin apertures arranged in rows and columns.

12. The air set molding apparatus of claim 11, further comprising at least four ejection pins movable between lowered and raised positions, wherein the pattern mounting plate includes more ejection pin apertures than the apparatus has ejection pins.

13. The air set molding apparatus of claim 9, where the pattern mounting plate includes a top side and bottom side and the ejection pin aperture of the pattern mounting plate extends through the top and bottom sides, further comprising a molding flask wherein the molding flask is set on the top side of the pattern mounting plate and the ejection plate is adjacent the bottom side of the pattern mounting plate.

14. The air set molding apparatus of claim 13, wherein the ejection plate includes an ejection pin aperture that receives the ejection pin to couple the ejection pin to the ejection plate for movement relative to the pattern mounting plate.

15. The air set molding apparatus of claim 14, wherein the ejection plate includes at least ten ejection pin apertures arranged in rows and columns, wherein the pattern mounting plate includes at least ten ejection pins in apertures arranged in rows and columns that relate to the rows and columns of the ejection pin apertures of the ejection plate.

16. An air set molding apparatus configured to form a sand mold, the apparatus comprising:

a pattern mounting plate including a plurality of ejection pin apertures arranged in rows and columns;

a molding flask on the pattern mounting plate, the molding flask having a closed lower end and an open upper end, the molding flask including first and second ejection pin apertures in the closed lower end;

first and second ejection pins movable relative to the pattern mounting plate and the molding flask, the first and second ejection pins movable through ejection pin apertures of the pattern mounting plate and the first and second ejection pin apertures of the molding flask between a lowered position and a raised position, an ejection plate, the ejection plate movable relative to the pattern mounting plate between a lowered position and a raised position, wherein the first and second ejection pins are coupled to the ejection plate for movement with the ejection plate and wherein movement of the ejection plate between the lowered and raised positions moves the first and second ejection pins between the lowered position to the raised position through the ejection pin apertures of the molding flask and the pattern mounting plate, where the pattern mounting plate includes a top side and a bottom side and the ejection pin apertures of the pattern mounting plate extend through the top and bottom sides, wherein the molding flask is set on the top side of the pattern mounting plate and the ejection plate is adjacent the bottom side of the pattern mounting plate, wherein as the first and second ejection pins move from the lowered position to the raised position, the first and second ejection pins lift the sand mold through the open upper end of the molding flask.

* * * * *